US007059403B2

(12) United States Patent
Arnoldo Barrientos et al.

(10) Patent No.: US 7,059,403 B2
(45) Date of Patent: Jun. 13, 2006

(54) ELECTROACOUSTIC METHOD AND DEVICE FOR STIMULATION OF MASS TRANSFER PROCESSES FOR ENHANCED WELL RECOVERY

(75) Inventors: Mario Arnoldo Barrientos, Huntington Beach, CA (US); Oleg Abramov, Moscow (RU); Vladimir Abramov, Moscow (RU); Andrey Pechkov, Moscow (RU); Alfredo Zolezzi-Garreton, Viña del Mar (CL); Luis Paredes-Rojas, Viña del Mar (CL)

(73) Assignee: Klamath Falls, Inc., Tortola (VG)

( * ) Notice: Subject to any disclaimer, the term of this patent is extended or adjusted under 35 U.S.C. 154(b) by 11 days.

(21) Appl. No.: 10/986,677

(22) Filed: Nov. 11, 2004

(65) Prior Publication Data

US 2006/0096752 A1 May 11, 2006

(51) Int. Cl.
*E21B 28/00* (2006.01)
*E21B 43/25* (2006.01)

(52) U.S. Cl. ..... 166/249; 166/177.1; 166/177.2; 166/369

(58) Field of Classification Search ..... 166/249, 166/177.1, 177.2, 311, 369
See application file for complete search history.

(56) References Cited

U.S. PATENT DOCUMENTS

| | | | | |
|---|---|---|---|---|
| 2,700,422 | A * | 1/1955 | Bodine, Jr. | 166/249 |
| 3,303,782 | A * | 2/1967 | Bodine, Jr. | 417/53 |
| 3,583,677 | A * | 6/1971 | Phillips | 366/120 |
| 4,345,650 | A * | 8/1982 | Wesley | 166/249 |
| 6,012,521 | A * | 1/2000 | Zunkel et al. | 166/249 |
| 6,105,712 | A * | 8/2000 | Lieng et al. | 181/114 |
| 6,491,095 | B1 * | 12/2002 | Kompanek | 166/249 |
| 6,619,394 | B1 * | 9/2003 | Soliman et al. | 166/249 |
| 2005/0003737 | A1 * | 1/2005 | Montierth et al. | 451/5 |

* cited by examiner

*Primary Examiner*—David Bagnell
*Assistant Examiner*—Shane Bomar
(74) *Attorney, Agent, or Firm*—The Hecker Law Group, PLC

(57) ABSTRACT

An electro acoustic device and related method increase production capacity of wells that contain oil, gas and/or water. The electro acoustic device produces vibrations stimulating occurrences of mass transfer processes within the well. The resultant acoustic flow generated in porous media, produced by superposition of longitudinal and shear waves, is developed over a characteristic frequency threshold value specific to water, normal oil and heavy oil, with an acoustic energy density capable of establishing higher fluidity zones in the porous media, promoting mobility and recovery of desired fluid and formation damage reduction in a wellbore.

24 Claims, 6 Drawing Sheets

ELECTROACOUSTIC METHOD AND DEVICE FOR STIMULATION OF MASS TRANSFER PROCESSES FOR ENHANCED WELL RECOVERY

BACKGROUND OF THE INVENTION

Present invention is related to the oil industry, particularly an electro acoustic system and associated method for increasing the production capacity of wells that contain oil, and consists of applying mechanical waves in a recovery zone of wells.

The productivity of oil wells decreases over time due to varied reasons. The two main causes of this decrease have to do with a decrease in relative permeability of crude oil, thus decreasing its fluidity, and progressive plugging of pores of a reservoir in a well bore region of a well due to accumulation of solids (clays, colloids, salts) that reduce the absolute permeability or interconnection of the pores. Problems associated with the aforementioned causes are: plugging of the pores by fine mineral particles that flow together with fluid to be extracted, precipitation of inorganic crusts, paraffin and asphaltene decantation, clay hydration, invasion of mud solids and mud filtration and invasion of completion fluids and solids resulting from brine injection. Each one of the reasons mentioned above may cause a decrease in the permeability or a restriction of flow in the region surrounding the well bore.

A well (FIG. 1) is basically a production formation lined with a layer of cement 19 and a case 10 that in turn holds a series of production tubes 11 placed coaxially within it. The well connects an oil reservoir, which has an appropriate permeability that allows the fluids produced in the formation 12 to flow through perforations 14 and/or holes 13 in the lining of the well, providing a route within the formation 12. The tubes 11 provide an outlet for the fluids 18 produced in the formation. Typically there are many perforations 14 which extend radially on the outside from the lined well. The perforations 14 are uniformly spaced out on the lining where it passes through the formation 12. Ideally, the perforations are placed only in the formation 12, so the number of these depends on the thickness of the formation 12. It is quite common to have nine to twelve perforations per meter of depth in the formation 12. On the other hand the perforations 14 extend in every longitudinal direction, so there are perforations 14 that can extend radially at an azimuth of 0° while additional perforations 14 are placed each 90° so as to define four groups of perforations 14 around the azimuth.

The fluids of the formation 12 flow through the perforations 14 entering the lined well. Preferably, the well is plugged by some sealing mechanism, such as a packer 15 or bridge plug placed beneath the level of the perforations 14. The packer 15 connects with the production tube 11 defining a compartment 16 into which the fluid produced from the formation 12 flows, filling the compartment (16) and reaching a fluid level (17). The accumulated fluid 18 flows from the formation 12 and may be accompanied by variable quantities of natural gas. In summary, the lined compartment accumulates oil, some water, natural gas and also sand and solid residues. Normally the sand settles in the bottom of the compartment 16. The fluid produced from the formation 12 may change phase in the event of a pressure reduction about the formation 12 which permits lighter molecules to vaporize. On the other hand, the well may also produce very heavy molecules.

After a period of time, the pathways through the perforations 14 extended within the formation 12 may clog with "fines" or residues. This defines the size of the pore that connects with the fluid within the formation 12, allowing it to flow from the formation 12, through the cracks or fissures or connected pores, until the fluid reaches the interstitial spaces within the compartment 16 for collection. During this flow, very small solid particles from the formation 12 known as "fines" may flow, but instead tend to settle. Whereas the "fines" may be held in a dispersed state for some time, they can aggregate and thus obstruct the space in the pore reducing the production rate of fluids. This can become a problem which feeds upon itself and results in a decrease in production flow. More and more "fines" may deposit themselves within the perforations 14 and obstruct them, tending to prevent even a minimum flow rate.

Even with the best production methods and the most favourable extraction conditions, a percentage higher than 20% of the crude oil originally existing within the reservoir typically remains behind.

The periodic stimulation of oil and gas wells is made using three general types of treatment: acidification, fracturing and treatment with solvents and heat. Acidification involves the use of HCl and HF acid mixtures which are injected into the production zone (rock). The acid is used to dissolve the reactive components of the rock (carbonates and clay minerals and, to a lesser extent, silicates) and thus increase its permeability. Additives such as reaction retardants and solvents are often added to enhance the performance of the acid at work. While acidizing is a common treatment for stimulating oil and gas wells, it clearly has some drawbacks, namely the high cost of chemicals and waste disposal costs involved.. The acids are often incompatible with the crude oil and may produce thick oily residues within the well. Precipitates formed after the acid is spent may often be more harmful than the dissolved minerals. The depth of penetration of the live acid is usually less than 5 inches.

Hydraulic fracturing is another technique commonly used for stimulation of oil and gas wells. In this process, great hydraulic pressures are used to create vertical fractures in the formation. The fractures may be filled with polymer plugs or treated with acid (in carbonates and soft rocks) to create conduits within the well that allow the oil and gas to flow. This process is extremely expensive (by a factor about 5 to 10 times more than the acid treatment). In some cases the fracture can extend into areas with water, increasing the amount of water produced (undesirable). Such treatments extend many hundreds of feet away from the well and are more commonly used in rocks with a low permeability. The ability to place polymer plugs successfully in all the fracture is usually limited and problems such as fracture closures and plug (proppant) crushing can severely deteriorate the productivity of hydraulic fractures.

One of the most common problems in mature oil wells is the precipitation of paraffin and asphaltene within and around the well. Steam or hot oil is injected into the well to melt and dissolve the paraffin in the oil, making everything flow to the surface. Organic solvents (such as xylene) are often used to remove asphaltenes, whose fusion point is high and are insoluble in alkanes. The steam as well as the solvents are very expensive (solvents more so than the steam) in particular when treating marginal wells that produce less than 10 bbls of oil per day. It should be noted that there are more than 100,000 of such wells only in the state of Texas and probably many more in other states in the USA.

The prime limitation for use of steam and solvents is the absence of mechanical agitation, required to dissolve or maintain in suspension the paraffin and asphaltenes.

In U.S. Pat. No. 3,721,297 to R. D. Challacombe, a tool is proposed for cleaning the wells by pressure pulses, whereby a series of explosive modules and gas generators are chain interconnected in such a way that the lighting of one of them triggers the next in one succession.

The explosions create shock waves that allow cleaning of the wells. This method has clear drawbacks, such as the potential danger of damaging high pressure oil and gas wells with explosives. This method is made unfeasible by the added risk of fire and lack of control during the treatment period.

The U.S. Pat. No. 3,648,769 to H. T. Sawyer describes a hydraulically controlled. diaphragm that produces "sinusoidal vibrations in low sonic range". The waves generated are of low intensity and are not directed or focused at the rock face. As a consequence, most of the energy propagates along the borehole.

U.S. Pat. No. 4,343,356 to E. D. Riggs et al. describes an apparatus for treating surface boreholes. The application of high voltage produces the generation of voltage arcs that dislodge the scale material from the walls of the well. Amongst the difficulties of this apparatus is the fact that the arc cannot be guided continuously, or even if any cleaning is accomplished at all. Additionally the subject of security remains unsolved (electrical and fire problems).

Another hydraulic/mechanical oscillator was proposed by A. G. Bodine (U.S. Pat. No. 4,280,557). Hydraulic pressure pulses created inside an elongated elastic tube are used to clean the lined walls of the wells. This system also suffers from low intensity and limited guiding.

Finally, a method for removing paraffin from oil wells was proposed by J. W. Mac Manus et al. (U.S. Pat. No. 4,538,682). The method is based on establishing a temperature gradient within the well by introducing a heating element into the well.

It is well known that the oil, gas and water wells, after some time of operation become obstructed and the fluid discharge declines, such that it becomes necessary to regenerate wells. The mechanical, chemical and conventional techniques for regenerating wells are the following:

Intensive rinsing

Shock pumping

Air treatment

Dissolution of sediments with hydrochloric acid or other acids combined with other chemicals.

High water pressure hosing

Injection of CO2

Generation of pressure shocks by use of explosives

These methods work with harmful chemicals, or work at such high power that they may be a risk to the structure of the well.

There exist a great number of effects associated to the exposure of solids and fluids to ultrasound fields of certain frequencies and power. Particularly in the case of fluids, it is possible to generate cavitation bubbles, that consists in the creation of bubbles from gasses dissolved in the liquid or from the phase change of this last. Other phenomena associated are degassing of liquid and the superficial cleaning of solid surfaces.

Ultrasound techniques have been developed with the aim of increasing the production of crude from oil wells. U.S. Pat. No. 3,990,512 to Arthur Kuris, titled "Method and System for Ultrasonic Oil Recovery", divulges a method and system for recovering oil by applying ultrasound generated by the oscillation produced while injecting high pressure fluids and whose aim is to fracture the reservoir so as to produce new drainage canals.

U.S. Pat. No. 5,595,243 to Maki, Jr. et al. proposes an acoustic device in which a set of piezoceramic transducers are used as radiators. This device presents difficulties in its fabrication and use, as it requires asynchronic operation of a great number of piezoceramic radiators.

U.S. Pat. No. 5,994,818 entitled "Device for Transferring Ultrasonic Energy into a Liquid or Pasty Medium", and U.S. Pat. No. 6,429,575, titled "Device for, Transmitting Ultrasonic Energy to a Liquid or pasty Medium", both belonging to Vladimir Abramov et al., propose an apparatus consisting of an alternate current generator that operates in the range of 1 to 100 kHz for transmitting ultrasonic energy and a piezoceramic or magnetostrictive transducer that emits longitudinal waves, which a tubular resonator coupled to a wave guide system (or sonotrode) transforms in turn to transversal oscillations in contact with the irradiated liquid or pasty medium. Notwithstanding, these patents are designed for use in containers of very big dimensions, at least in comparison with the size and geometry of perforations present in oil wells. This presents limitations of dimension as well as in transmission mode if increasing production capacity of oil wells is desired.

U.S. Pat. No. 6,230,799 to Julie C. Slaughter et al., titled "Ultrasonic Downhole radiator and Method for Using Same", proposes a device using ultrasonic transducers made with Terfenol-D alloy, placed in the bottom of the well and fed by an ultrasound generator placed at the surface. The disposition of the transducers on the axis of the device allows emitting in a transversal direction. This invention poses a decrease in viscosity of hydrocarbons contained inside the well through emulsification when reacting with an alkaline solution injected into the well. This device considers surface forced fluid circulation as a cooling system, to guarantee irradiation continuity.

U.S. Pat. No. 6,279,653 to Dennos C. Wegener et al., titled "Heavy Oil Viscosity Reduction and Production", presents a method and device for producing heavy oil (API gravity lower than 20) by applying ultrasound generated by a transducer, made with Terfenol alloy, attached to a conventional extraction pump and fed by a generator placed at the surface. This invention also considers the presence of an alkaline solution, like a watery solution of Sodium Hydroxide (NaOH) for generating an emulsion with crude in the reservoir of lesser density and viscosity, and thereby making the crude easier to recover by pumping. Here, a transducer is placed in an axial position so as to produce longitudinal emissions of ultrasound. The transducer connects to an adjoining rod that acts as a wave guide (or sonotrode) to the device.

U.S. Pat. No. 6,405,796 to Robert J. Meyer, et al., titled "Method for Improving Oil Recovery Using an Ultrasound Technique", proposes a method for increasing the recovery of oil using an ultrasonic technique. The proposed method consists of the disintegration of agglomerates by ultrasonic irradiation posing the operation in a determined frequency range with an end to stimulating fluids and solids in different conditions. The main mechanism of crude recovery is based on the relative movement of these components within the reservoir. All the preceding patents use the application of ultrasonic waves through a transducer, fed externally by an electric generator, whose transmission cable usually exceeds a length of 2 km. This brings with it the disadvantage of losses in the transmission signal, which means that a signal has to be generated sufficiently strong so as to allow the appropriate functioning of the transducers within the well, because the amplitude of the high frequency electric current at that depth decreases to a 10% of the initial value.

As the transducers must work with a high power regime, an air or water cooling system is required, presenting great difficulties when placed inside the well, meaning that the ultrasonic intensity must not be greater than 0,5–0,6 W/cm2. This quantity is insufficient for the purpose in mind as the threshold for acoustic effects in oil and rocks is 0,8 to 1 W/cm2.

RU Patent No. 2,026,969,belonging to Andrey A. Pechkov entitled "Method for Acoustic Stimulation of Bottom-hole zone for producing formation, RU N° 2,026,970 belonging to Andrey A. Pechkov et al., entitled "Device for Acoustic Stimulation of Bottom-hole zone of producing formation"., U.S. Pat. No. 5,184,678 to Andrey A. Pechkov et al., entitled "Acoustic Flow Stimulation Method and Apparatus", divulge methods and devices for stimulating production of fluids from inside a producing well. These devices incorporate as innovative element an electric generator together with the transducer, both integrated at the bottom of the well. These transducers operate in a non continuous regimen allowing them to work without requiring an external cooling system.

A suitable stimulation of the solid materials requires efficiency in the transmission of the acoustic vibrations from the transducers to the rock of the reservoir, which in turn is determined by the different acoustic impedances inside the well (rocks, water, walls, and oil, amongst others). It is well known that the reflection coefficient is high in a liquid-solid interface, which means that the quantity of waves passing through the steel tube will not be the most adequate to act in the interstices of the orifices that communicate the well with the reservoir.

SUMMARY OF THE INVENTION

One of the main objectives of present invention is to develop a highly efficient acoustic method that provides high mobility of fluids in a well bore region.

Another objective is to provide a down hole acoustic device that generates extremely high energy mechanical waves capable of removing fine, organic, crust and organic deposits both in and around the well bore.

An additional objective is to provide a down hole acoustic device for oil, gas and water wells that does not require the injection of chemicals to stimulate them.

Another objective is to provide a down hole acoustic device that does not have environmental treatment costs associated with fluids that return to the well after treatment.

A down hole acoustic device is provided that can function inside a tube without requiring removal or pulling of said tube. In some embodiments the tube can be any diameter, typically about 42 mm in diameter. In some embodiments, the tube is 42 mm in diameter.

Finally, it is desirable to provide a down hole acoustic device that can be run in any type of completion hole, cased/perforated hole, gravel packed, screens/liners, etc.

DETAILED DESCRIPTION OF THE INVENTION

Figure 1:
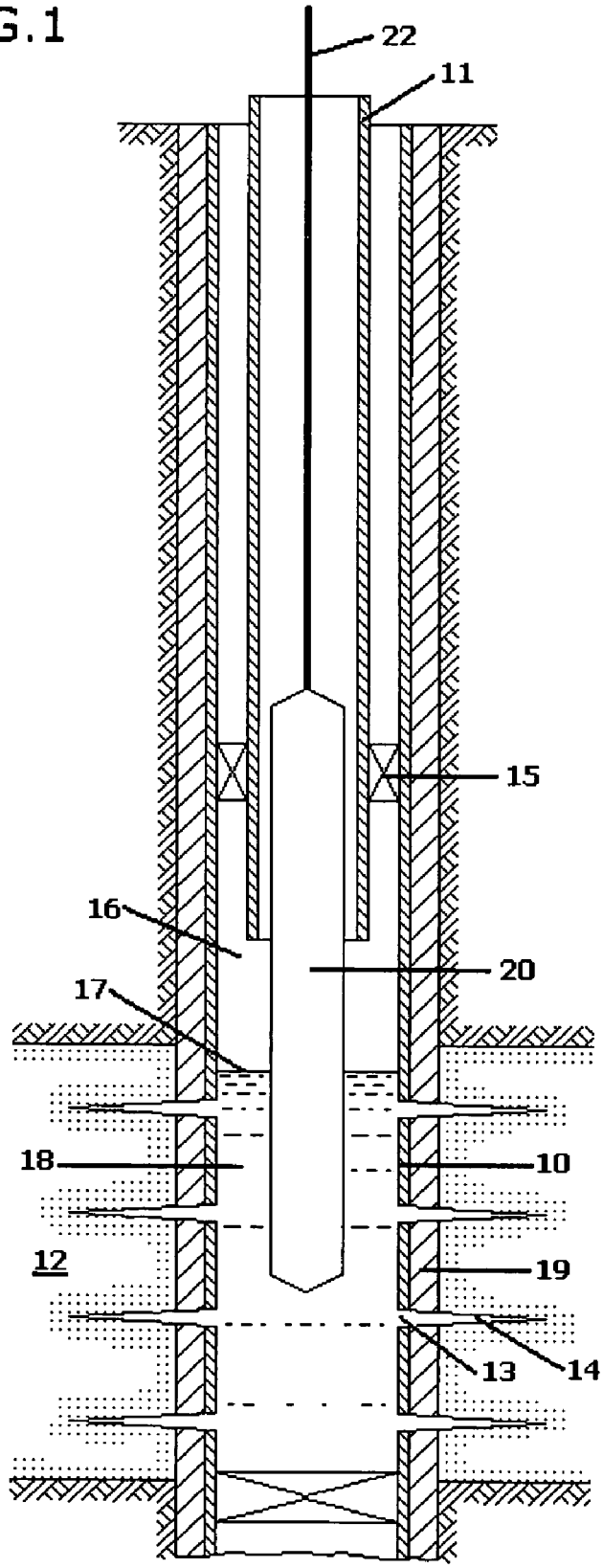
FIG. 1 shows an exemplary irradiation device in accordance with the teachings disclosed herein.

In accordance with the present disclosure, (see FIG. 1) and with the purpose of increasing permeability of a well bore region (12) of oil, gas and/or water wells, a method and device, are disclosed for stimulating said well bore region (12) with mechanical vibrations, with an end to promoting formation of shear vibrations in an extraction zone due to the displacement of phase of mechanical vibrations produced along an axis of the well, achieving alternately tension and pressure forces due to the superposition of longitudinal and shear waves, and stimulating in this way the occurrences of mass transference processes within the well.

The oil, gas and/or water wells comprise a metal pipe or casing (10), cement (19) between the casing (10) and the well bore region (12), an inner metal pipe or tubing (11) inside the casing (10), and a packer (15) between the casing (10) and the tubing (11). The casing (10) near the well bore region (12) is perforated with a machine that produces holes (13) in the casing (10) and fissures (14) in the cement (19) and in the well bore region (12), to allow the fluids from the well bore region (12) to flow to the well. The extraction zone of the well consists of a liquid phase (18) made of oil and/or water, and a gas phase (16) above the level (17) of the liquid phase (18). The electro acoustic device (20) is lowered to the extraction zone of the well with a logging cable (22).

Figures 2A, 2B, 2C, 2D:
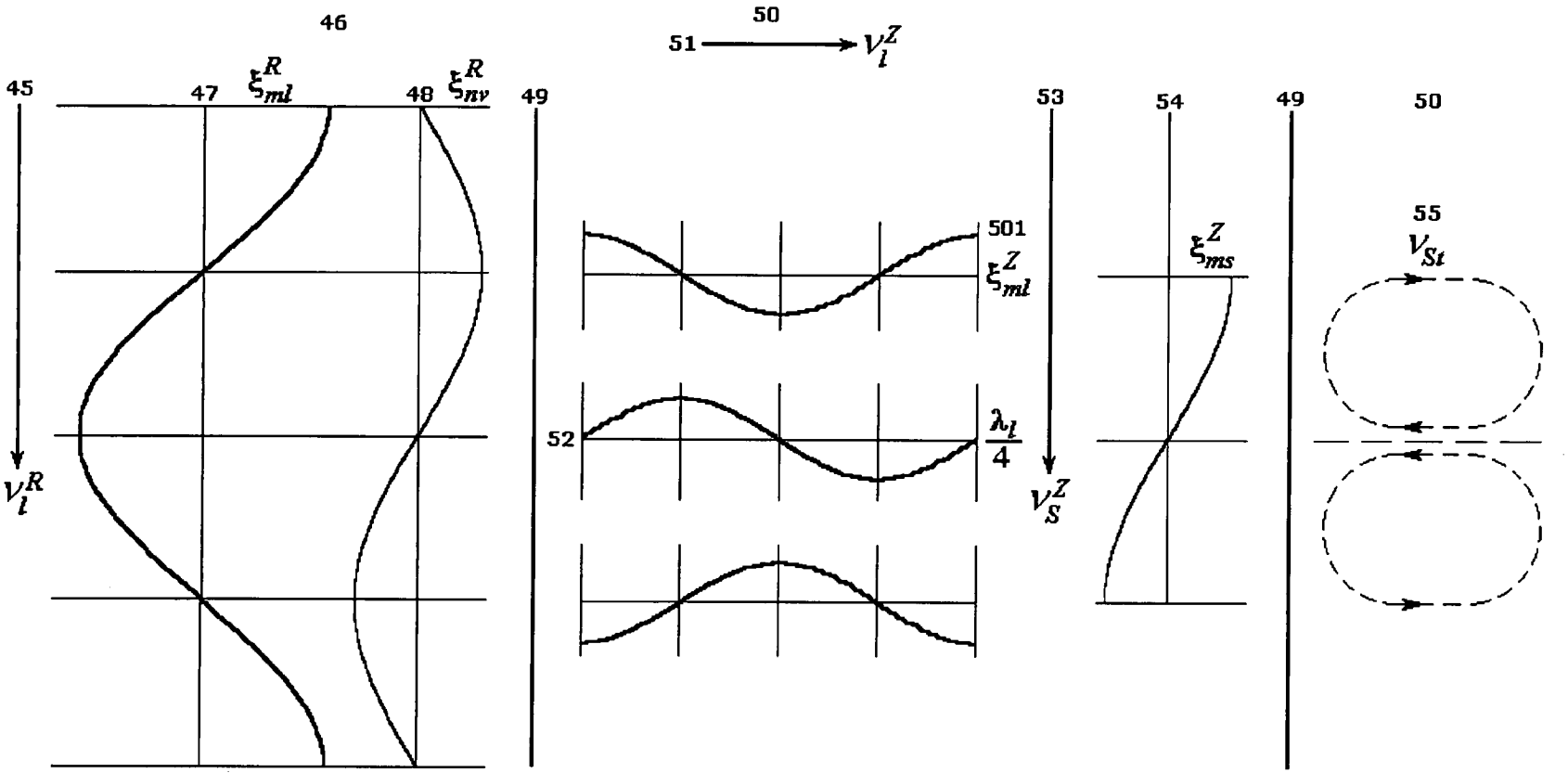
FIGS. 2*a*–2*d* are diagrams illustrating an exemplary method in accordance with the present disclosure.

This is illustrated by the diagrams presented in FIGS. 2*a*–2*d* . FIG. 2*a* shows the vector of oscillating velocity $V^R_l$ (45) of longitudinal vibrations that propagate in a radiator (46), is directed along the axis of the radiator, while the amplitude distribution of vibratory displacements $\zeta^R_{ml}$ (47) of longitudinal vibrations also propagate along the radiator. In lieu of this, as a result of the Poisson effect, radial vibrations are generated in the radiator (46) with a characteristic distribution with displacement amplitude of $\zeta^R_{nv}$ (48).

FIG. 2*b* shows the radial vibrations through the radiating surface (49) of the radiator (46) are transmitted into the well bore region (50). The speed vector $V^z_l$ (51) of the longitudinal vibrations propagate in the well bore region (50) in a direction perpendicular to the axis of the radiator. Waveforms 52 show the characteristic radial distribution of the displacement amplitudes $\zeta^z_{ml}$ (501) of the radial vibrations propagating in the well bore region (50) and radiated from points of the radiator localized at a distance equal to $\lambda_l/4$ (where $\lambda$ is the wavelength of the longitudinal wave in the radiator material).

FIG. 2*c* shows the phase shift of the radial vibrations propagating in the medium leads to the appearance of shear vibrations in the well bore region, whose vector of oscillating velocity $V^z_s$ (53) is directed along the radiator axis. Graph 54 shows the characteristic distribution of displacement amplitudes of shear vibrations $\zeta^z_{ms}$.

As a result (see FIG. 2*d*), an acoustic flow (55) is produced in the well bore region (50) due to the superposition of longitudinal and shear waves with speed ($U_f$) and characteristic wavelength $\lambda_l/4$.

The operating frequency of the generated acoustic field corresponds at least to the characteristic frequency defined by equation 1.

$$f = F_A \frac{\eta\phi}{2\pi k\delta} \quad \text{Equation 1}$$

where $\phi$ and k are the porosity and permeability of the formation, that is, well bore region (50) from which extract originates, $\delta$ and $\eta$ are the density and dynamic viscosity of the pore fluid in the well bore region and $F_A$ is the amplitude factor for relative displacement of fluid with regard to the porous media.

Table 1 provides characteristic frequency values obtained when using equations, with an amplitude factor of 0.1, for assumed $\phi$ and k reservoir rock properties. Viscosities for water, normal oil and heavy oil are assumed to be 0.5 mPa, 1.0 mPa and 10 mPa respectively

TABLE 1

| | | Values of characteristic frequency | | |
|---|---|---|---|---|
| | | Characteristic frequency, KHz | | |
| $\phi$ [%] | k [mD] | $\eta$ = 0.5 mPa s (water) | $\eta$ = 1 mPa s (normal oil) | $\eta$ = 10 mPa s (heavy oil) |
| 5 | 0.1 | 4000 | 8000 | 80000 |
| 10 | 1 | 800 | 1600 | 16000 |
| 15 | 20 | 60 | 120 | 1200 |
| 20 | 300 | 5.3 | 10.6 | 106 |
| 30 | 1000 | 2.5 | 5 | 50 |

Figure 3:
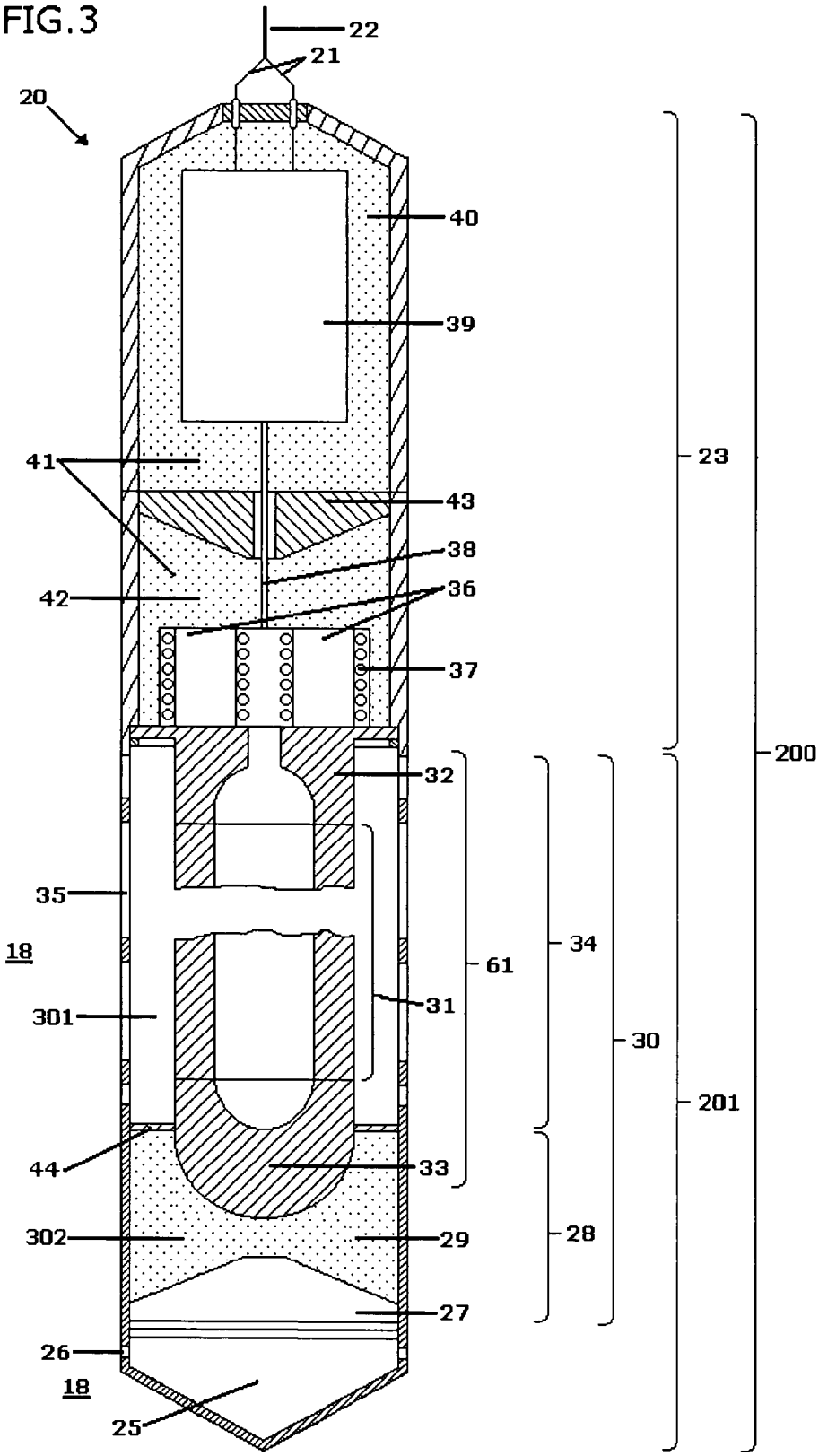
FIG. 3 shows a longitudinal section view through an exemplary acoustic unit.

The method described in the preceding paragraphs is implemented, in particular, in the device shown in FIG. 3, where said device is situated within a well.

Turning to FIG. 3, an electro-acoustic device (20) which comprises a closed case (200), preferably of cylindrical shape and known as a sonde, is lowered into the well by an armoured cable (22), comprised preferably by wires, and in which one or more electrical conductors (21) are provided with armoured cable (22), also referred to as a logging cable.

The closed case (200) is constructed with a material that transmits vibrations. The closed case (200) has two sections, an upper case (23) and a lower case (201). The lower case (201), at its furthest end has two internal cavities, a first cavity (25) and compensation chamber (302). First cavity (25) communicates with the exterior by means of small holes (26). Fluid (18) to be recovered from the well bore region, may flow through these small holes (26) into first cavity (25). This fluid (18), once it has filled the first cavity (25), is allowed to compensate the pressure in the well bore region with that of the device (20). The compensation chamber (302) is flooded with a cooling liquid (29), which acts on an expansible set of bellows (27), which in turn allow the expansion of it into compensation area (28) of the lower case (201).

Over the compensation chamber (302), there lies a second chamber (301), named "stimulation chamber", placed in a stimulation zone (34) of the lower case (201). The stimulation zone (34) has holes (35) which provides an increase in the level of transmission of acoustic energy to the formation (12).

Second chamber and compensation chamber (301 and 302) form a great chamber (30) that houses a wave guide or sonotrode (61). The sonotrode (61) has a horn (32), a radiator (31), and a hemisphere shaped end (33). Said radiator (31) has a tubular geometric shape with an outer diameter $D_o$, its nearer end (proximal to armoured cable (22)) has the shape of horn (32) placed within the stimulation chamber (301), while its further end has the shape of a hemisphere with an inner diameter of $D_o/2$, placed inside the compensation chamber (302). Both chambers are sealed by a perimetrical flange (44) which, in turn sustains the hemisphere shaped end (33) of the radiator (31). The geometric dimensions of the tubular part of the radiator (external diameter "$D_o$", length "L" and wall thickness "$\delta$") are determined by the working conditions under resonance parameters of longitudinal and radial vibrations in the natural resonance frequency of an electro acoustic transducer (36).

To implement the above stated principle mentioned previously in the discussion of FIG. 2, about formation of superposition of longitudinal and shear waves in the well bore region, length "L" of the tubular piece (radiator 31) of the sonotrode (61) is not less than half the length of the longitudinal wave $\lambda$ in radiator material, which is $L > \lambda/2$.

The horn (32) is welded to transducer (36), which preferably should be an electro acoustic transducer such as a magnetostrictive or piezoceramic transducer, surrounded by a coil (37).

To better the cooling system, the transducer (36) is constructed in two parts (not shown in FIG. 2).

The coil (37) is adequately connected with an electric conductor (38) which extends from a power source (39) placed in a separate compartment (40) within upper case (23). Power source (39) is fed from the surface of the well by conductors (21) in the armoured cable (22). The power source (39) and the transducer (36) are cooled with liquids (41) existent in compartments that contain them (40 and 42 respectively). The compartments (40 and 42) are separated by a perforated disk (43).

Figure 4:
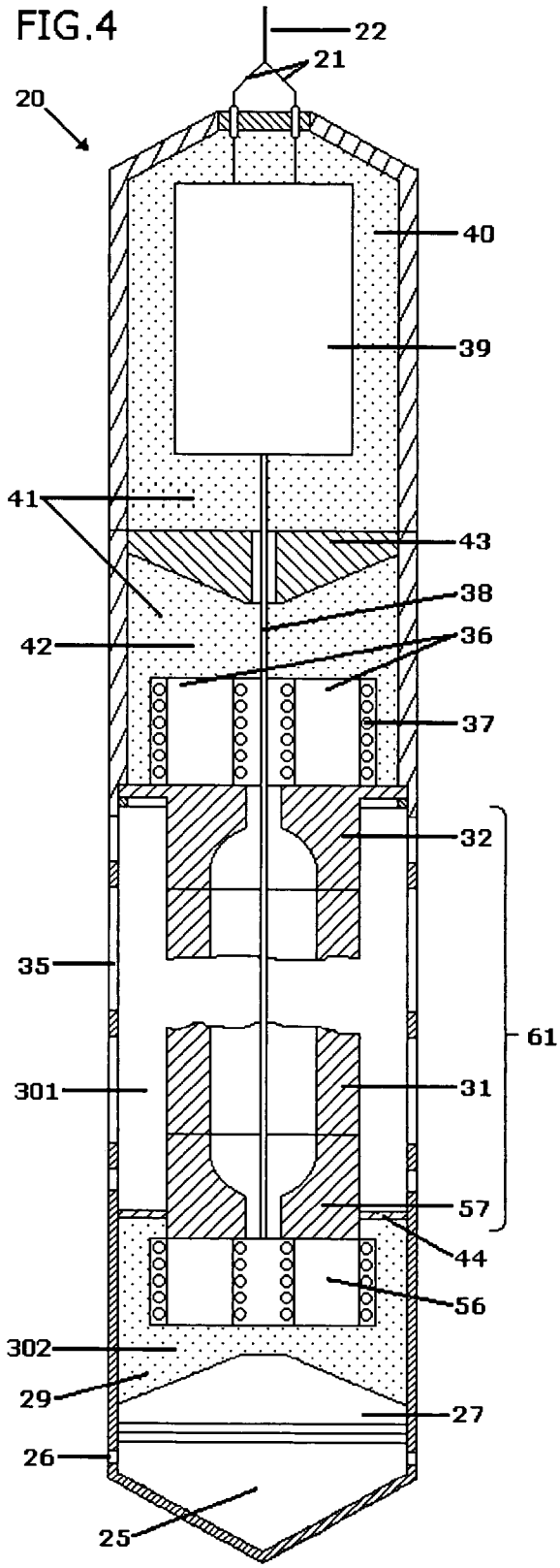
FIG. 4 shows a more detailed diagram of a second modality of an exemplary acoustic unit disclosed herein.

To increase the acoustic power supplied to the well bore region, at least a second transducer (56), preferably an electro acoustic transducer, operating in phase with the first transducer (36), is added to the device (20) as shown in FIG. 4. Power source (39) is connected to both transducers (36 and 56) with a common feeding conductor (38).

In this case, the sonotrode (61) has two horns (32 and 57) and a radiator (31). The radiator (31) takes on a tubular shape with both ends finishing in a half wave horn shape (32 and 57).

Figure 5:
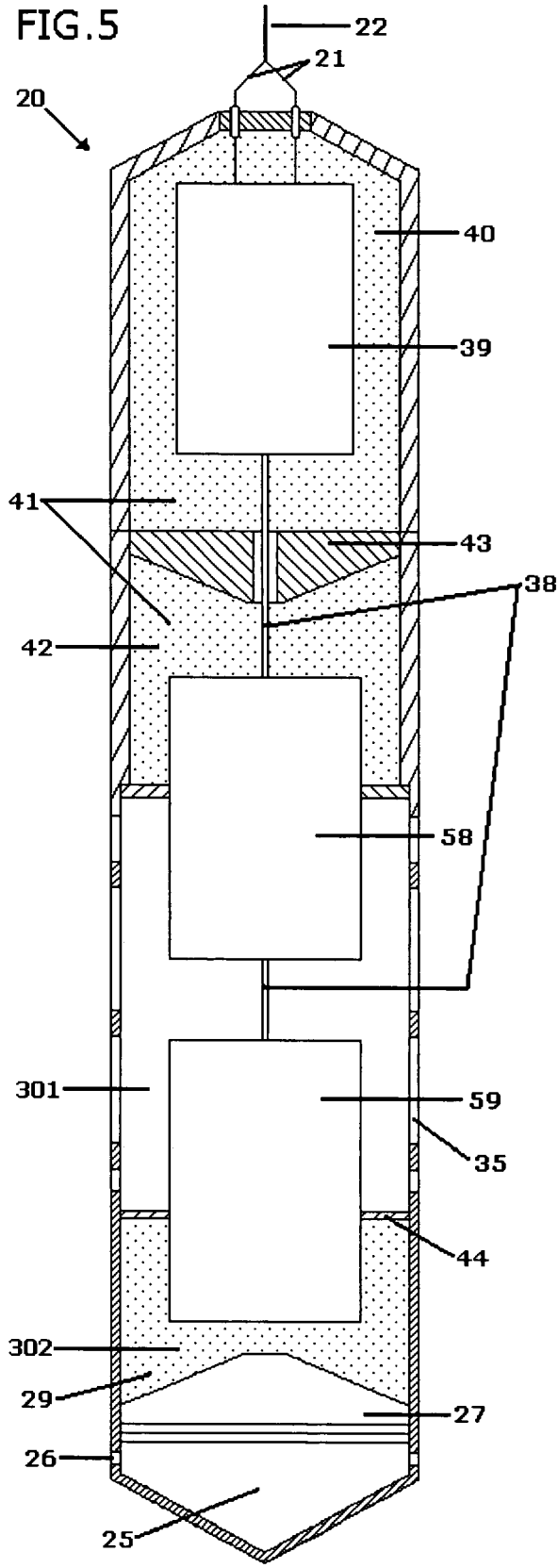
FIG. 5 shows a diagram of a third modality of an exemplary acoustic unit.

FIG. 5 shows another modality for developing the specified principle for formation of longitudinal and shear waves in the well bore region, where the device (20) includes 2 or 2 n (where n is a whole number) vibratory systems (58 and 59), for which the electro acoustic transducers of each pair operate in phase and every pair next to the vibratory system operates in antiphase with respect to the previous vibratory system.

The power source (39) is connected to transducers of each vibratory system (58 and 59) with a common feeding conductor (38).

The other elements for constructing this system are analogous to those described previously in FIG. 3.

Figure 6:
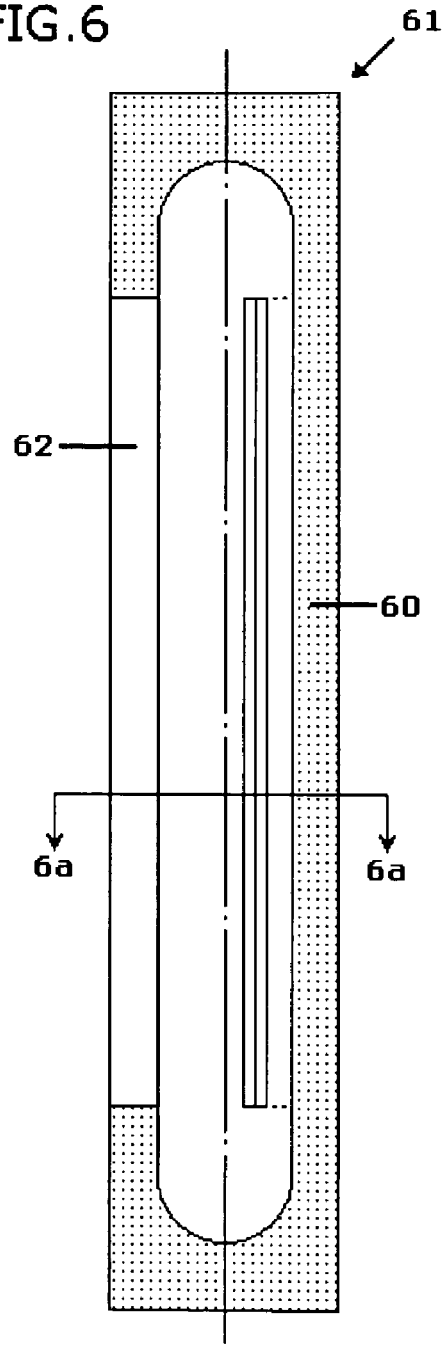
FIG. 6 is a sectional view through a fourth modality of an exemplary irradiation device.
Figure 6A:
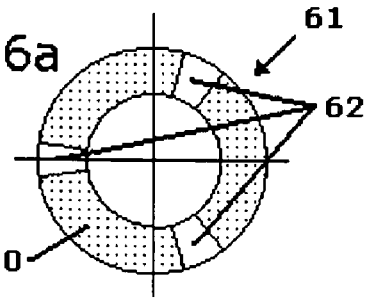
FIG. 6*a* is a cross section of FIG. 6 along the line A—A.

To increase the operating efficiency of the sonotrode (61), its construction is modified in accordance with FIGS. 6 and 6*a*.

As exemplified in FIGS. 6 and 6*a*, the sonotrode (61) has a cylindrical housing (60) in which one or more longitudinal grooves (62) are designed/provided. In one embodiment longitudinal grooves (62) varying in number from 2 to 9. The length of these grooves (62) is a multiple of half the $\lambda$ wavelength of waves transmitted by the electro acoustic device, while their width may vary in a range of about 0.3 $D_o$ to about 1.5 $D_o$, in particular embodiments 0.3 $D_o$ to 1.5 $D_o$.

What is claimed is:

1. A method of stimulating the occurrence of mass transfer processes which increase production capacity of wells containing oil, gas and/or water, comprising:

(a) introducing mechanical vibrations into a well bore region of a well to produce shear vibrations in said well bore region due to phase displacement of mechanical vibrations produced along an axis of said well; and (b) achieving alternately tension and pressure within said well by superposition of longitudinal and shear waves in porous media irradiated thereby and within said well, thereby stimulating the occurrences of mass transference processes within said well;

wherein said superposition of longitudinal and shear waves provides an acoustic flow in the well bore region with speed $U_f$ and wavelength $\lambda/4$, and wherein a displacement frequency of an acoustic field providing said acoustic flow is at least a value corresponding to a characteristic frequency calculated for said porous media to be irradiated.

2. The method in accordance with claim 1, wherein the generated acoustic field induces higher fluidity zones in porous media as a result of generated inertial forces that are greater than viscous forces of said irradiated media.

3. The method in accordance with claim 1, wherein said acoustic flow promotes removal of formation damage in the well bore region.

4. An electro acoustic device for stimulation of mass transfer processes that increase production capacity of wells that contain oil, gas and/or water, comprising:

(a) a sonotrode whose irradiation surface is disposed along an axis of a well and having a length equal to or more than half of a characteristic wavelength of generated vibrations, said sonotrode producing shear vibrations in the well bore region due to the displacement of phase of mechanical vibrations produced along the axis of the well and achieving, alternately, tension and pressure due to superposition of longitudinal and shear waves produced thereby and establishing resultant mass transference processes within wells that contain oil, gas and/or water, wherein said superposition of longitudinal and shear waves conform to provide an acoustic flow with speed $U_f$ and wavelength $\lambda/4$;

wherein said sonotrode has a tubular geometric shape with dimensions determined by operating conditions under resonance parameters of longitudinal and radial vibrations of a natural resonance frequency of an electro acoustic transducer contained in said electro acoustic device, wherein said natural resonance frequency is at least a value corresponding to a characteristic frequency calculated for media to be irradiated by said electro acoustic device;

and wherein said tubular geometric shape has an external diameter, $D_o$ , and has one end horn-shaped and an opposite end that is hemisphere-shaped with an inner diameter of $D_o/2$.

5. The electro acoustic device in accordance with claim 4, wherein said electro acoustic transducer is a magnetostrictive electro acoustic transducer.

6. The electro acoustic device in accordance with claim 4, wherein said electro acoustic transducer is a piezoelectric electro acoustic transducer.

7. The electro acoustic device in accordance with claim 4, wherein said electro acoustic device includes 2 or more electro acoustic transducers forming a vibratory system operating in phase, connected to said sonotrode at distances that are multiples of half the wavelength of longitudinal and radial waves generated.

8. The electro acoustic device in accordance with claim 7, comprising 2 n vibratory systems, which when grouped into consecutive pairs, the electro acoustic transducers of each pair of vibratory system operate in phase, and every next pair operates in antiphase with regard to the vibratory system adjacent thereto.

9. The electro acoustic device in accordance with claim 8, wherein n is a whole number.

10. The electro acoustic device in accordance with claim 6, wherein said sonotrode includes a cylindrical housing having at least two grooves.

11. The electro acoustic device in accordance with claim 10, wherein said grooves are parallel to a longitudinal axis of said sonotrode and have a length that is a multiple of half the wavelength generated by said electro acoustic device and whose width is in the range of 0.3 to 1.5 $D_o$.

12. The electro acoustic device in accordance with claim 11, wherein said electro acoustic transducer is a magnetostrictive electro acoustic transducer.

13. The electro acoustic device in accordance with claim 11, wherein said electro acoustic transducer is a piezoelectric electro acoustic transducer.

14. The electro acoustic device in accordance with claim 11, wherein said electro acoustic device includes two or more electro acoustic transducers forming a vibratory system operating in phase, connected to said sonotrode at distances that are multiples of half the wavelength of longitudinal and radial waves generated.

15. The electro acoustic device in accordance with claim 14, comprising 2 n vibratory systems, which when grouped into consecutive adjacent pairs, the electro acoustic transducers of each pair of vibratory system operate in phase, and every next pair operates in antiphase with regard to the vibratory system adjacent thereto.

16. The electro acoustic device in accordance with claim 15, wherein n is a whole number.

17. A method for increasing productivity of wells containing oil, gas and/or water, comprising:

(a) introducing an electro acoustic device into a well having a well bore region;

(b) activating said electro acoustic device, wherein said activating step introduces mechanical vibrations into said well bore region;

(c) producing shear vibrations in said well bore region due to phase displacement of mechanical vibrations produced along an axis of said well;

(d) establishing alternating tension and pressure forces within said well by irradiating porous media adjacent said well bore region and within said well via superposition of longitudinal and shear waves in porous media, thereby stimulating occurrence of mass transference processes within said well;

(e) providing a resultant acoustic field and flow in said porous media, wherein a displacement frequency of said acoustic field is at least a value corresponding to a characteristic frequency of the porous media to be irradiated; and (f) receiving a desired fluid from said well.

18. The method in accordance with claim 17, wherein said generated acoustic field induces higher fluidity zones in said porous media as a result of generated inertial forces that are greater than viscous forces of said irradiated media.

19. The method in accordance with claim 17, wherein said superposition of longitudinal and shear waves conform to provide an acoustic flow having a speed of $U_f$ and wavelength $\lambda/4$.

20. The method in accordance with claim 19, further comprising the step of calculating said characteristic frequency for said porous media to be irradiated.

21. The method in accordance with claim 21, wherein said electro acoustic device includes a sonotrode whose irradiation surface is disposed along an axis of said well, said sonotrode having a length equal to or more than half of a characteristic wavelength of generated vibrations.

22. The method in accordance with claim 21, wherein said electro acoustic device includes at least two or more electro acoustic transducers forming a vibratory system operating in phase, connected to said sonotrode at distances that are multiple of half the wavelength of longitudinal and radial waves generated.

23. The method in accordance with claim 21, further comprising the step of providing 2 n vibratory systems, which when grouped into consecutive adjacent pairs, the electro acoustic transducers of each pair of vibratory system operate in phase, and every next pair operates in antiphase with regard to the vibratory system adjacent thereto.

24. The method in accordance with claim 21, wherein said sonotrode includes a plurality of longitudinal grooves, said grooves being provided such that they are evenly spaced along a perimeter of a cylindrical housing of said sonotrode.

* * * * *